US009538309B2

(12) United States Patent
Nielsen

(10) Patent No.: US 9,538,309 B2
(45) Date of Patent: Jan. 3, 2017

(54) REAL-TIME LOUDSPEAKER DISTANCE ESTIMATION WITH STEREO AUDIO

(71) Applicant: BANG & OLUFSEN A/S, Struer (DK)

(72) Inventor: Jesper Kjaer Nielsen, Aalborg (DK)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 15/050,609

(22) Filed: Feb. 23, 2016

(65) Prior Publication Data

US 2016/0249153 A1 Aug. 25, 2016

(30) Foreign Application Priority Data

Feb. 24, 2015 (DK) ..... 2015 00105
Sep. 25, 2015 (DK) ..... 2015 00562

(51) Int. Cl.
*H04S 7/00* (2006.01)
*H04R 5/02* (2006.01)

(52) U.S. Cl.
CPC ..... *H04S 7/301* (2013.01); *H04R 5/02* (2013.01); *H04S 7/305* (2013.01); *H04R 2205/024* (2013.01)

(58) Field of Classification Search
CPC ..... H04S 7/301; H04S 7/302; H04S 7/305; G01K 11/16; G01K 11/178
USPC ..... 381/307, 107, 64
See application file for complete search history.

(56) References Cited

U.S. PATENT DOCUMENTS

| | | | | |
|---|---|---|---|---|
| 8,279,709 | B2 | 10/2012 | Choisel et al. | |
| 2006/0062398 | A1 | 3/2006 | McKee Cooper et al. | |
| 2007/0223714 | A1* | 9/2007 | Nishikawa | G10K 11/1788 381/71.1 |
| 2009/0003613 | A1 | 1/2009 | Christensen | |
| 2016/0225366 | A1* | 8/2016 | Maeda | G10K 11/1784 |

FOREIGN PATENT DOCUMENTS

WO WO2014/160419 10/2014

OTHER PUBLICATIONS

Denmark Search Report issued in Denmark Application No. PA 2015 00562, dated Feb. 5, 2016, which the instant application claims priority to; 5 pgs.

* cited by examiner

*Primary Examiner* — Mohammad Islam
(74) *Attorney, Agent, or Firm* — Harness, Dickey & Pierce, P.L.C.

(57) ABSTRACT

A method for estimating a distance between a first and a second loudspeaker characterized by playing back a first stereo source signal vector $s_1$ on the first loudspeaker, and playing back a second stereo source signal vector $s_2$ on the second loudspeaker, acquiring a first recorded signal vector $x_1$, using a first microphone arranged adjacent to the first loudspeaker, and acquiring a second recorded signal vector $x_2$ from a second microphone arranged adjacent to the second loudspeaker, wherein $x_1$ and $x_2$ are N-dimensional vectors, setting the distance equal to $\eta v/f$, where v is the speed of sound, f is the sampling frequency, and $\eta$ is an estimated sample delay of a source signal played back on one of the loudspeakers and a recording acquired by a microphone at the other loudspeaker.

8 Claims, 2 Drawing Sheets

REAL-TIME LOUDSPEAKER DISTANCE ESTIMATION WITH STEREO AUDIO

TECHNICAL FIELD

This invention relates to control and use of multimedia rendering systems including loudspeakers, in which it's relevant to know the exact position of any of the loudspeakers relative to a user position.

BACKGROUND OF THE INVENTION

The distribution of a number of loudspeakers relative to the listening position has a large impact on the listening experience and the perceived spaciousness of sound. Often, however, the loudspeakers are not placed in the optimal position since other interior design considerations take higher priority or the desired listening position moves. This can to some extent be compensated for by preprocessing the loudspeaker signals. However, in order to apply the correct preprocessing, the location of the loudspeakers relative to the listening position must be known.

Existing approaches to solving this loudspeaker localization problem can roughly be dichotomized into two groups. In the first group, synthetic test signals such as sinusoidal sweeps or maximum length sequences (MLS) are used as calibration signals. This has the advantage of high estimation accuracy, but also requires the user to actively start the calibration sequence every time, e.g., the listening position or the loudspeaker locations change. This is solved in the second group of methods by adding a calibration signal to the desired audio signal. The calibration signal is shaped psycho-acoustically and hidden inside the audio signal so that it is inaudible to the listener. Consequently, the energy of the calibration signal is low compared to the energy of the audio signal. This is a problem since the audio signal is considered to be "noise" in the source localization algorithm, and this affects the estimation accuracy.

It is also known to use the audio signal for source localization. However, audio signals are much more difficult to work with since they are heavily correlated in both time and in between the loudspeaker channels and have an unknown frequency content. Consequently, it is hard to estimate impulse responses, and the simple cross-correlation methods for loudspeaker localization fail. Synthetic calibration signals, on the other hand, can be designed to be uncorrelated and to have a desirable frequency content. Thus, the simple cross-correlation methods and impulse response peak picking can be used to compute the distances and/or direction of arrivals (DOAs) between the loudspeakers and/or to the listening position.

Document US 2006/0062398 discloses estimation of a distance from a loudspeaker to a microphone using a downsampled adaptive filter to find the impulse response. The microphone is not located in the same place as another loudspeaker.

Document U.S. Pat. No. 8,279,709 discloses localization using only the desired audio signals. Specifically, the case where to estimate the distance between two loudspeakers playing back a stereo music signal. Distances between all the loudspeaker pairs in a set of loudspeakers can be used to form an Euclidean distance matrix to which the positions of the loudspeakers can be fitted using, e.g., the multidimensional scaling (MDS) algorithm or the algorithm by Crocco known from prior art.

In U.S. Pat. No. 8,279,709 it is assumed that a microphone is mounted on every loudspeaker, which is referred to as a transceiver, so that they are approximately co-located. This assumption is used in the proposed estimator of the distance to take into account that both transceivers in a transceiver pair should measure the same distance. This increases the robustness of the estimator.

GENERAL DISCLOSURE OF THE INVENTION

The present invention generally relates to methods of using music or speech signals for the localization of a number of loudspeakers. Specifically, it is considered the case where the distance between two loudspeakers, each equipped with a single microphone, is estimated. An ML estimator is provided for this problem and demonstrated that it could be used to obtain real-time distance estimates to within an accuracy of one millimeter for even a low sampling frequency. Only frame-by-frame processing was considered, but outliers can be removed and higher accuracy can be achieved by smoothing the computed estimates.

A first aspect of the invention is a method according to claim 1. A second aspect of the invention is a method for estimating the distance between two loudspeakers playing back stereo audio such as music or speech, on each of the loudspeakers a number of microphones are placed, and the distance estimation is based on data from recordings made by these microphones as well as on the loudspeaker source signals, the estimation algorithm characterized by:

(a) takes room reverberation and measurement noise into account by using statistical modelling;

(b) produce subsample delay estimation without resorting to any heuristic interpolation methods, this is achieved by using symmetric frequency indices so that the conjugate symmetry of the spectrum of the source signal is maintained even for non-integer time delays;

(c) the estimator of the distance is linearly related to a delay $\eta$ (in samples) and with a cost function $J(\eta)$, and a covariance matrix $C_1$ modelling both reverberation and measurement noise, and where (d) a matrix $[R_i]$ the matrix filtering out the loudspeakers own signal in the microphone recordings, and where (e) an N-dimensional vector $X_i$ containing the recording from the microphone on loudspeaker i; and (f) the estimate of the delay is the maximum likelihood estimate and is there for optimal asymptotically in the number of data.

According to these aspects, the estimate of the sample delay is the maximum likelihood estimate and is therefore optimal asymptotically in the number of data. Subsample delay estimation may be accomplished without resorting to any heuristic interpolation methods, by using symmetric frequency indices so that the conjugate symmetry of the spectrum of the source signal is maintained even for non-integer time delays.

In addition, the applied method in the current invention also formulates the signal model so that the estimator produces estimates from a continuous set without resorting to any heuristic interpolation method. This is in contrast to many of the proposed localization methods whose resolution is bound to the sampling grid.

The method may further comprise estimating an orientation of the two loudspeakers relative to each other, including acquiring a first set of at least three recorded signal vectors using a set of at least three microphones arranged adjacent to the first loudspeaker, and acquiring a second set of at least three recorded signal vectors using a set of at least three microphones arranged adjacent to the second loudspeaker, estimating a distance from the first loudspeaker to each microphone on the second loudspeaker, estimating a distance from the second loudspeaker to each microphone on the first loudspeaker, and determining an orientation of the first and second loudspeaker relative to each other based on the distances.

BRIEF DESCRIPTION OF THE DRAWINGS

These and other aspects of the invention will be described in more detail with reference to the appended drawings showing example embodiments of the invention.

DETAILED DESCRIPTION OF CURRENTLY PREFERRED EMBODIMENTS

Figure 1:
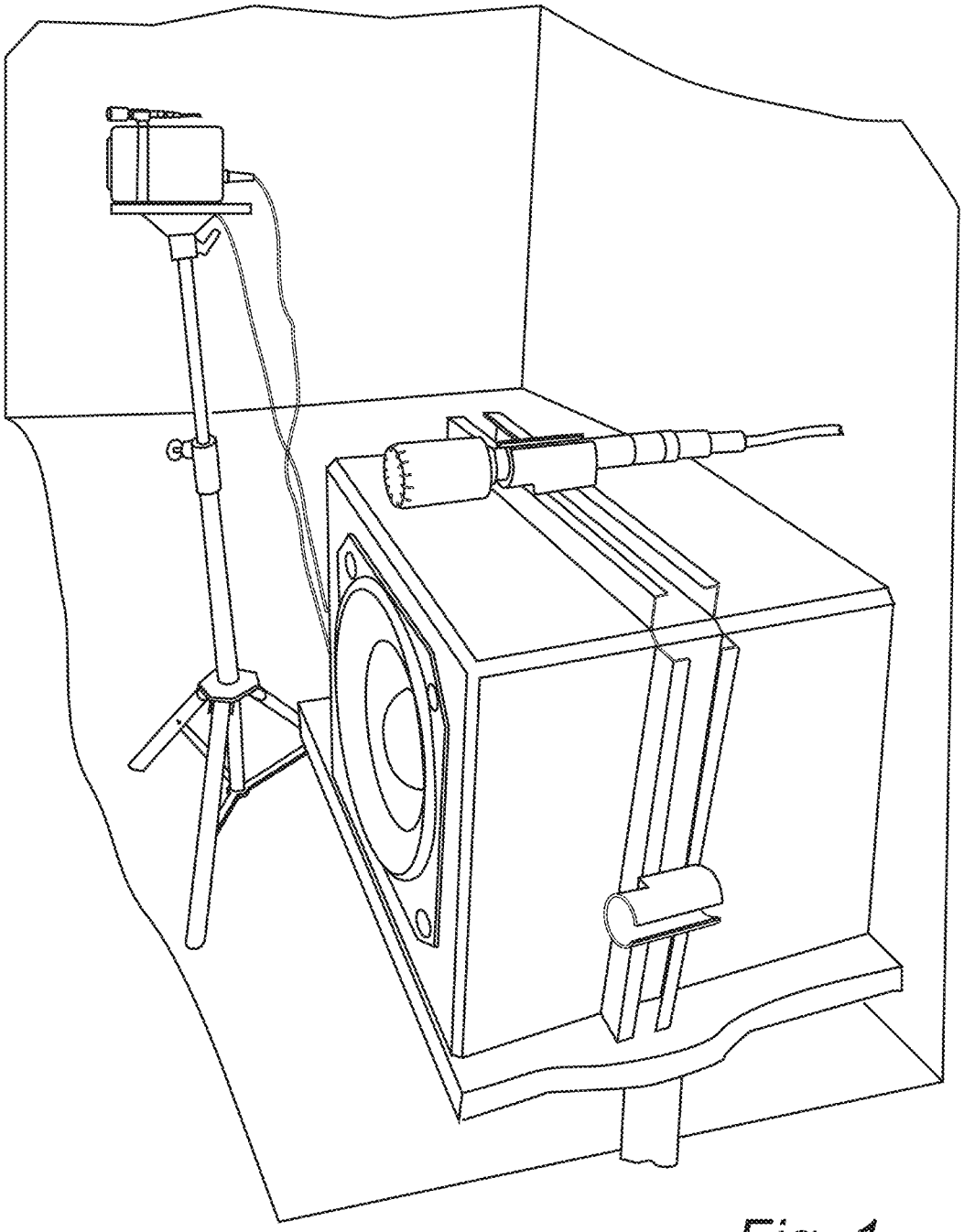
FIG. 1 is an illustration of a stereo setup, including loudspeakers and microphones.

As alluded to in the introduction, a main aspect is estimating the distance between two transceivers playing back stereo music or a speech signal. In the invention, a transceiver is a loudspeaker with a microphone mounted close to the diaphragm of the loudspeaker. The developed estimator is not only limited in scope to this special case, but can also be used for the problem where the direct distance should be estimated from a loudspeaker to a microphone, e.g., placed at the listening position, and for the problem where the distance to a reflector should be estimated using just one transceiver. These special cases are obtained by appropriately selecting the source and sensor signals.

The Signal Model

It is assumed that the two transceivers record N samples each, and having the model these as $$x_1(n)=q_{11}(n)+q_{21}(n)+e_1(n) \tag{1}$$

$$x_2(n)=q_{22}(n)+q_{12}(n)+e_2(n) \tag{2}$$

where $e_i(n)$ and $q_{ki}(n)$ are the noise recorded by transceiver i and the signal recorded by transceiver i from transceiver k, respectively. Thus, $q_{ii}(n)$ is the part of the microphone signal $x_i(n)$ which originates from transceiver i. This signal is not of interest as it does not contain any information on the distance between the transceivers, and therefore wishes to suppress it as much 15 as possible. To do that, a model $q_{ii}(n)$ as $$q_{ii}(n)=\sum_{m=0}^{M-1} h_i(m)s_i(n-m) \tag{3}$$

where $s_i(n)$ and $h_i(m)$ are a source signal sample of transceiver i and an FIR filter coefficient of the ith M-length transceiver filter, respectively. Thus, a transceiver filter models the acoustic impulse response between the loudspeaker and microphone on a transceiver. It is assumed that the loudspeakers and microphones are all connected to the same system so that the source signals are known. On the other hand, the transceiver filters are assumed unknown since these might be slowly time-varying due to, e.g., temperature changes. These transceiver filters are very important in order to attenuate the contribution of $s_i(n)$ in $x_i(n)$ since only $q_{ki}(n)$for $k\neq i$ contains information about the distance between the transceivers. Therefore, $q_{ki}(n)$ is modelled explicitly in terms of the delay parameter (in samples) $\eta\in[M,K]$ with M<K<, which is estimated, and the gain $\beta\geq 0$ as $$q_{ki}(n)=\beta s s_k(n-\eta),\ \text{for } i\neq k. \tag{4}$$

This model describes the sound propagation of the direct path. Note that the reverberation is later modelled as part of the noise and that $\beta$ and $\eta$ are not indexed since it is assumed that they are the same for both $q_{12}(n)$ and $q_{21}(n)$.

Defining the vectors $$x_1=[x_i(0)x_i(1)\ \ldots\ x_i(N-1)]^T \tag{5}$$

$$x=[hd\ \mathbf{1}^T x_2^T]^T \tag{6}$$

$$s_i(\eta)=[s_i(-\eta)s_i(1-\eta)\ \ldots\ s_i(N-1-\eta)]^T \tag{7}$$

$$e_i=[e_i(0)e_i(1)\ \ldots\ e_i(N-1)]^T \tag{8}$$

$$e=[e_1^T e_2^T]^T \tag{9}$$

$$h_i=[h_i(0)h_i(1)\ \ldots\ h_i(M-1)]^T. \tag{10}$$

it follows that the signal model can be written as $$x=\begin{bmatrix} B_1 & 0 & s_2(\eta) \\ 0 & B_2 & s_1(\eta)\end{bmatrix}\begin{bmatrix} h_1 \\ h_2 \\ \beta\end{bmatrix}+e \tag{11}$$

$$=Bh+s(\eta)\beta+e \tag{12}$$

where the definitions of B, h, and $s(\eta)$ are obvious and $$B_i=[s_i(0)s_i(1)\ \ldots\ s_i(M-1)] \tag{13}$$

is a convolution matrix. To summarize, so far a signal model which is linear in the unknown transceiver filters $h_1$ and $h_2$ and the gain $\beta$ and is non-linear in the delay $\eta$. The main reason for using this signal model is that, the linear parameters can easily be separated out of the problem leaving the single nonlinear parameter $\eta$, which is interested in estimating. Before deriving the estimator for $\eta$, however, making a number of assumptions about the source signal and the noise which enables sub-sample delay estimation, drastically reduces the computational complexity, and increases the robustness of the resulting estimator.

The Source Signals

Most scientific literature on time of arrival (TOA), time difference of arrival (TDOA), and DOA estimation formulates these problems in the frequency domain since a delay in the time domain corresponds to a phase-shift in the frequency domain. Consequently the delay parameter, can be separated out analytically from the source signal and modelled as a continuous parameter. For finite length signals, however, a delay in the time domain only corresponds to a phase shift in the frequency domain if the signal is periodic with fundamental frequency radians per sample (or an integer multiple thereof). Consider very long segments compared to the delay, intended to estimate, it gives a big error by assuming that the source signals are periodic. Thus, the relations $$s_i(\eta)=ZA_i d(\eta) \tag{14}$$

$$B_i=ZA_iF \tag{15}$$

where it is defined $$z(\omega)=[1\ \exp(j\omega)\ \exp(j\omega(N-1))]^T \tag{16}$$

$$Z=[z(-2\pi L/N)\ \ldots\ 1\ \ldots\ z(2\pi L/N)] \tag{17}$$

$$d(\eta)=[\exp(j2\pi\eta L/N) \ldots 1 \ldots \exp(-j2\pi\eta L/N)]^T \quad (18)$$

$$A_i=N^{-1}\mathrm{diag}(Z^H s_i(0)) \quad (19)$$

$$F=[d(0)d(1) \ldots d(M-1)]. \quad (20)$$

Note that the time indices are symmetric around zero from −L to L where L=N/2 if N is even and L=(N−1)/2 if N is odd.

This is necessary to ensure that $s_l(n)$ is real-valued for non-integer values of n.

The Noise

It is assumed that the noise consists of two parts $$e_i=\omega_i+v_i \quad (21)$$

where the first part is due to reverberation and the second part is measurement noise. These two are assumed to be independent, and the measurement noise is modelled as white Gaussian noise with variance $\sigma^2$. In the model $w_i$ is a delayed and weighted sum of the two source signals so that $$w_i = \sum_{m=2}^{M} (s_1(\eta_{1i,m})\beta_{1i,m} + s_2(\eta_{2i,m})\beta_{2i,m}) \quad (22)$$

where $\eta_{1i,m}$ and $\beta_{1i,m}$ are the m'th reflection and gain from transceiver 1 to transceiver i. The summation index is running from m=2 to indicate that the first component is already included in the model via (4). A critical assumption is that all reflections are uncorrelated so that $$E[w_i w_k^H] \approx 0 \quad (23)$$

$$E[w_i w_i^H] \approx \sum_{m=2}^{M} E[s_1(\eta_{1i,m})\beta_{1i,m}^2 s_1^H(\eta_{1i,m}) + s_2(\eta_{2i,m})\beta_{2i,m}^2(\eta_{2i,m})] \quad (24)$$

$$\approx \gamma\sigma^2 Z(A_1 A_1^H + A_2 A_2^H)Z^H \quad (25)$$

where $\gamma$ is an uninteresting scale parameter and the last expression follows from the decomposition in (14) and that $$E\left[\sum_{m=2}^{M} d(\eta_{i,m})\beta_{i,m}^2 d^H(\eta_{i,m})\right] \approx \gamma\sigma^2 I_N. \quad (26)$$

These assumptions are hard to justify theoretically, but have been demonstrated to work well in practice. Under these assumptions, the covariance matrix of the noise can be written as $$C = E[ee^H] \approx \begin{bmatrix} C_1 & 0 \\ 0 & C_2 \end{bmatrix} \quad (27)$$

$$C_i \approx \gamma\sigma^2[Z(A_1 A_1^H + A_2 A_2^H)Z^H + \gamma^{-1} I_N]. \quad (28)$$

Applying the matrix inversion lemma to $C_i$−1, it is obtained that $$C_i^{-1}=\sigma^{-2}[I_N-N^1 ZZ^H+(N^2\gamma)^{-1}ZQZ^H] \quad (29)$$

Where it is defined $$Q=(A_1 A_1^H+A_2 A_2^H+(N\gamma)^{-1}I_N)^{-1}. \quad (30)$$

With these, it is obtained $$Z^H C_i^{-1}=(\sigma^2 N\gamma)^{-1}QZ^H \quad (31)$$

$$Z^H C_i^{-1} Z=(\sigma^2\gamma)^{-1}Q \quad (32)$$

which proves to be useful later.

A Maximum Likelihood Estimator

The log-likelihood function pertaining to the model in (12) is given by $$l(h_1, h_2, \beta, \eta, \sigma^2, \gamma) = -\frac{1}{2}[\ln|C| + (x - Bh - s(\eta)\beta)^H C^{-1}(x - Bh - s(\eta)\beta)] \quad (33)$$

where all terms which do not depend on the unknown parameters have been ignored. Whereas the linear parameters h and $\beta$ and the noise variance $\sigma^2$ can be separated out of the likelihood function, the scale factor $\gamma$ cannot. Since $\gamma$ is only a nuisance parameter, it is known and large. Thus, it is assumed that the reverberation energy is much larger than that of the measurement noise. It is found that this works very well in practice. As seen from (30), this means that $(N\gamma)^{-1}$ acts as a regularization parameter.

To derive the maximum likelihood (ML) estimator for the delay $\eta$, the following steps are performed. Given $\eta$ and $\beta$, the ML-estimate of the transceiver filters is given by $$\hat{h}(B^H C^{-1} B)^{-1} B^H C^{-1}(x-s(\eta)\beta). \quad (34)$$

Inserting this estimate back into the log-likelihood function in (33) and only keeping the terms which depend on $\eta$ and $\beta$ give the optimization problem (note that $R^H C^{-1} R = C^{-1} R$)

$$\hat{\beta}, \hat{\eta} = \underset{\beta\geq 0, \eta\in[M,K]}{\mathrm{argmin}} (x - s(\eta)\beta)^H C^{-1} R(x - s(\eta)\beta) \quad (35)$$

where $R=\mathrm{diag}(R_1,R_2)$ is a block diagonal matrix with $R_i=I_N-B_i(B_i^H C_i B_i)^{-1}B_i^H C_i^{-1}$.

Despite the nonnegative constraint on the gain $\beta$, it can still be separated out of the optimization problem. The final 1D optimization problem for the delay is then $$\hat{\eta} = \underset{\eta\in[M,K]}{\mathrm{argmaxmax}}(J(\eta), 0) \quad (36)$$

where the cost function is given by $$J(\eta) = \frac{s_2^H(\eta)C_1^{-1}R_1 x_1 + s_1^H(\eta)C_2^{-1}R_2 x_2}{\sqrt{s_2^H(\eta)C_1^{-1}R_1 s_2(\eta) + s_1^H(\eta)C_2^{-1}R_2 s_1(\eta)}}.$$

This cost function is highly non-linear in $\eta$ so it is proposed to find $\eta$ using a two step procedure. First, a coarse value for $\eta$ is computed from a search over J(n) on a uniform grid. Secondly, the coarse estimate is refined using a line searching method such as a Fibonacci search.

FIG. 1 displays a picture of a stereo setup, including loudspeaker transducer and microphones.

The table below gives an overview of the results, and precision of the distance obtained by means of 3 different types of source signals.

TABLE 1

Standard deviation in mm of the estimated distance for three source signals in a simulated and real environment.

| Type | WGN | Music | Speech |
|---|---|---|---|
| Simulation | 0.28 | 0.78 | 0.18 |
| Measurement | 0.61 | 1.42 | 1.13 |

Efficient Implementation

The cost function $J(\eta)$ can be evaluated efficiently by using the intermediate results in (14), (15), (31), and (32), and by computing the economy size singular value decomposition (SVD) so that $$Z^H C_u^{-1} R_i = (\sigma^2 N\gamma)^{-1} Q^{1/2} (I_N - U_i U_i^H) Q^{1/2} Z^H.$$

These results allow us to write the cost function as $$J(\eta) = \frac{d^H(\eta)(y_1 + y_2)}{\sqrt{2L + 1 - d^H(\eta)(K_1 + K_2)d(\eta)}} \tag{37}$$

where (for $k \neq i$)

$$y_i = A_k^H Q^{1/2} (I_N - U_i U_i^H) Q^{1/2} Z^h X_1 \tag{38}$$

$$K_i = A_i^H A^{1/2} U_i U_i^H Q^{1/2} A_i. \tag{39}$$

Note that $Z^H x_i$ and all elements of the diagonal matrices $A_i$ and Q can be computed using an FFT algorithm. Moreover, $d^H(\eta)K_i d(\eta)$ is approximately zero and depends only weakly on $\eta$ since $d(\eta)$ is asymptotically orthogonal to the columns of F for $\eta \geq M$. Therefore, in practice only the numerator in the cost function is sufficient to find the coarse estimate of $\eta$. On the Fourier grid, the numerator can be computed using a single FFT whereas the denominator requires 2M FFTs.

The basic method has been evaluated in both a simulated and a real environment. The former is necessary to be able to compare the produced estimates to a ground truth, which is unknown and not well defined in a real environment. Specifically, the estimator evaluated for three different source signals: (1) a white Gaussian noise signal, (2) a stereo music signal, and (3) a stereo speech signal. All signals played back and recorded at a sampling rate of 44.1 kHz. The source signals to the loudspeakers were also recorded to remove internal delays in the PC and the sound card. Data frames of four seconds were obtained with a 75% of overlap between the successive frames. The data were downsampled by a factor of four since the 3" loudspeakers used in the measurements and shown in FIG. 1 have a very non-linear response at the higher frequencies.

A MATLAB implementation of the proposed algorithm can process this amount of data in real-time on a standard desktop PC. For this sampling frequency and a speed of sound of 343 m/s, the sampling grid corresponds to a resolution of 3.1 cm.

Figure 2:
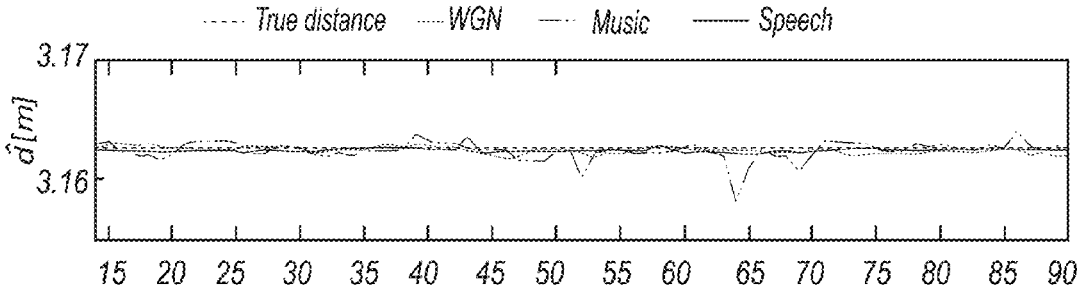
FIG. 2 shows an excerpt of the results of the simulation.

FIG. 2 shows an excerpt of the results of the simulation where the sources were assumed to be point sources and artificial reverberation was added with a reverberation time of 0.5 seconds. From the figure and Table 1, it is seen that sub-millimeter accuracy is obtained for all source signals.

Figure 3:
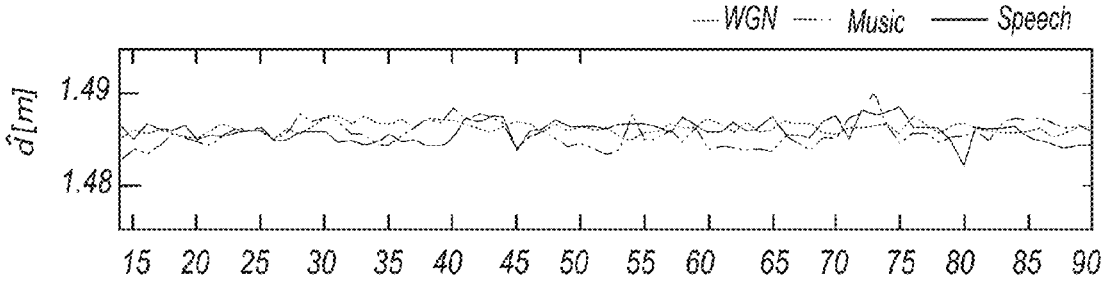
FIG. 3 shows how the variation of the estimates increased in the real environment.

FIG. 3 and Table 1 displays that the variation of the estimates increased in the real environment despite that the loudspeakers were closer together. The main reason for this is that loudspeakers are not omnidirectional point sources. Instead, especially the higher frequencies are attenuated from one loudspeaker to the other when the loudspeakers are configured in a stereo setup as in FIG. 1, i.e., they are not pointed towards each other. Moreover, the acoustic centre of the loudspeaker is typically in front of the loudspeaker and frequency dependent.

Although not shown here, outliers in the estimated distances occur occasionally. These happen typically in very silent parts of the music/speech and can be removed by using a sound activity detector or by post-processing the computed estimates using a smoothing algorithm. However, even without these heuristics, it is possible to estimate the transceiver distance to a millimeter precision for even a modest sampling frequency.

The invention is very applicable in multimedia systems, including multichannel- or surround sound systems, distributing sound in a high quality. The disclosed feature are useful in rendering of sound in single rooms including one or more sound zones.

By placing three (or more) microphones on each loudspeaker, a set of three distances from each loudspeaker to the other may be estimated using the method disclosed herein. Based on these sets, the orientation of the loudspeakers with respect to each other may be determined using simple trigonometric functions and methods known in the art. The three microphones may be placed in a number of ways, but as an example they may be placed in a circular pattern in one plane, e.g. centered on the loudspeaker driver.

What is claimed is:

1. A method for estimating a distance between a first and a second loudspeaker characterized by:

(a) playing back a first stereo source signal vector $s_1$ on the first loudspeaker, and playing back a second stereo source signal vector $s_2$ on the second loudspeaker;

(b) acquiring a first recorded signal vector $x_1$, using a first microphone arranged adjacent to the first loudspeaker, and acquiring a second recorded signal vector $x_2$ from a second microphone arranged adjacent to the second loudspeaker, wherein $x_1$ and $x_2$ are N-dimensional vectors;

(c) setting the distance equal to $\eta v/f$, where v is the speed of sound, f is the sampling frequency, and $\eta$ is an estimated sample delay of a source signal played back on one of the loudspeakers and a recording acquired by a microphone at the other loudspeaker, (d) where the delay $\eta$ is estimated by $$\hat{\eta} = \underset{\eta \in [M,K]}{\operatorname{argmax}} \max(J(\eta), 0)$$

having a cost function $J(\eta)$ given by $$J(\eta) = \frac{s_2^H(\eta) C_1^{-1} R_1 x_1 + s_1^H(\eta) C_2^{-1} R_2 x_2}{\sqrt{s_2^H(\eta) C_1^{-1} R_1 s_2(\eta) + s_1^H(\eta) C_2^{-1} R_2 s_1(\eta)}}.$$

where:

$s_i(\eta) = Z A_i d(\eta)$ is the source signal vector to loudspeaker i shifted by i samples, where $$z(\omega) = [1 \ \exp(j\omega) \ \ldots \ \exp(j\omega(N-1))]^T$$

$$Z = [z(-2\pi L/N) \ \ldots \ 1 \ \ldots \ z(2\pi L/N)]$$

$$d(\eta) = [\exp(j2\pi\eta L/N) \ \ldots \ 1 \ \ldots \ \exp(-j2\pi\eta L/N)]^T$$

$$A_i = N^{-1} \operatorname{diag}(Z^H s_i(0))$$

N is the number of elements in the vector $S_i(\eta)$, and L=N/2 if N is even and L=(N−1)/2 if N is odd; where:

$$C_i=\gamma\sigma^2[Z(A_1A_1^H+A_2A_2^H)Z^H+\gamma^{-1}I_N].$$

is a covariance matrix modeling both reverberation and measurement noise, where $\sigma^2$ is an unknown variance of the measurement noise and $\gamma$ is a scaling factor; and where:

$$R_i=I_N-B_i(B_i^HC_i^{-1}B_i)^{-1}B_i^HC_i^{-1}$$

is a matrix filtering out the loudspeakers own signal in the microphone recordings, where $$B_i=ZA_iF$$

$$F=[d(0)d(1)\ldots d(M-1)]$$

and M is a user-defined length of the filter.

2. The method according to claim 1, further comprising using statistical modelling to take room reverberation and measurement noise into account.

3. The method according to claim 1, further comprising estimating an orientation of the two loudspeakers relative to each other, including:

acquiring a first set of at least three recorded signal vectors using a set of at least three microphones arranged adjacent to the first loudspeaker, and acquiring a second set of at least three recorded signal vectors using a set of at least three microphones arranged adjacent to the second loudspeaker, estimating a distance from the first loudspeaker to each microphone on the second loudspeaker, estimating a distance from the second loudspeaker to each microphone on the first loudspeaker, and determining an orientation of the first and second loudspeaker relative each other based on said distances.

4. The method according to claim 1, further comprising FFT processing and singular value decomposition of the cost function $J(\eta)$.

5. The method according to claim 1, further comprising implementing the method as either batch processing or as adaptive processing.

6. The method according to claim 5, wherein estimates are based on a single batch of data, a length of a single batch being for example three seconds.

7. The method according to claim 6, wherein estimates are updated more frequently than the length of a single batch, by using overlapping batches.

8. The method according to claim 5, where in the adaptive processing, the data are weighted with an exponential window having a forgetting factor which is controlled by the user.

* * * * *